US005801582A

United States Patent [19]

Weber

[11] Patent Number: 5,801,582

[45] Date of Patent: Sep. 1, 1998

[54] ACTIVATABLE/DEACTIVATABLE CIRCUIT ARRANGEMENT FOR PRODUCING A REFERENCE POTENTIAL

[75] Inventor: Stephan Weber, Munich, Germany

[73] Assignee: Siemens Aktiengesellschaft, Munich, Germany

[21] Appl. No.: 862,239

[22] Filed: May 23, 1997

[30] Foreign Application Priority Data

May 24, 1996 [DE] Germany ..... 196 21 110.7

[51] Int. Cl.[6] ..... G05F 1/10

[52] U.S. Cl. ..... 327/539; 327/538; 327/530; 327/540; 323/312; 323/313

[58] Field of Search ..... 327/530, 535, 327/538, 539, 540, 544; 323/312, 313, 314, 315

[56] References Cited

U.S. PATENT DOCUMENTS

| | | | |
|---|---|---|---|
| 5,278,491 | 1/1994 | Nitta et al. | 323/313 |
| 5,488,329 | 1/1996 | Ridgers | 327/539 |
| 5,703,476 | 12/1997 | Merlo et al. | 323/314 |
| 5,712,556 | 1/1998 | Okamura | 327/539 |

FOREIGN PATENT DOCUMENTS 0 411 657 2/1991 European Pat. Off. .

OTHER PUBLICATIONS

Japanese Abstract, vol. 18, No. 426, JP6131068, May 13, 1994.

P. Gray et al., "Analysis and Design of Analog Integrated Circuits", Second Edition, University of California, pp. 292–297.

*Primary Examiner*—Timothy P. Callahan

*Assistant Examiner*—Jung Ho Kim

*Attorney, Agent, or Firm*—Hill & Simpson

[57] ABSTRACT

Activatable/deactivatable circuit arrangement for producing an output reference voltage having a first transistor (T1) whose emitter is connected with a reference potential (M) and whose base and collector are connected with one another, having a second transistor (T2) whose base is connected with the base of the first transistor (T1), having a first resistor (R1) that is connected between the collector of the first transistor (T1) and an output terminal (U) for supplying the output reference voltage, having a second resistor (R2) that is connected between the collector of the second transistor (T2) and the output terminal (U), having a third resistor (R3) that is connected between the emitter of the second transistor (T2) and the reference potential (M), having a third transistor (T3) whose base is connected with the collector of the second transistor (T2) and whose emitter is connected with the reference potential (M), and having a controlled current source (T4) that is connected between a supply potential (V) and the output terminal (U), and that is coupled at the input side with the collector of the third transistor (T3), whereby the collector-emitter path of a fifth transistor (T5) is connected in parallel with the collector-emitter path of the third transistor (T3), and the base of the fifth transistor (T5) being driven by a switching signal (S).

9 Claims, 1 Drawing Sheet

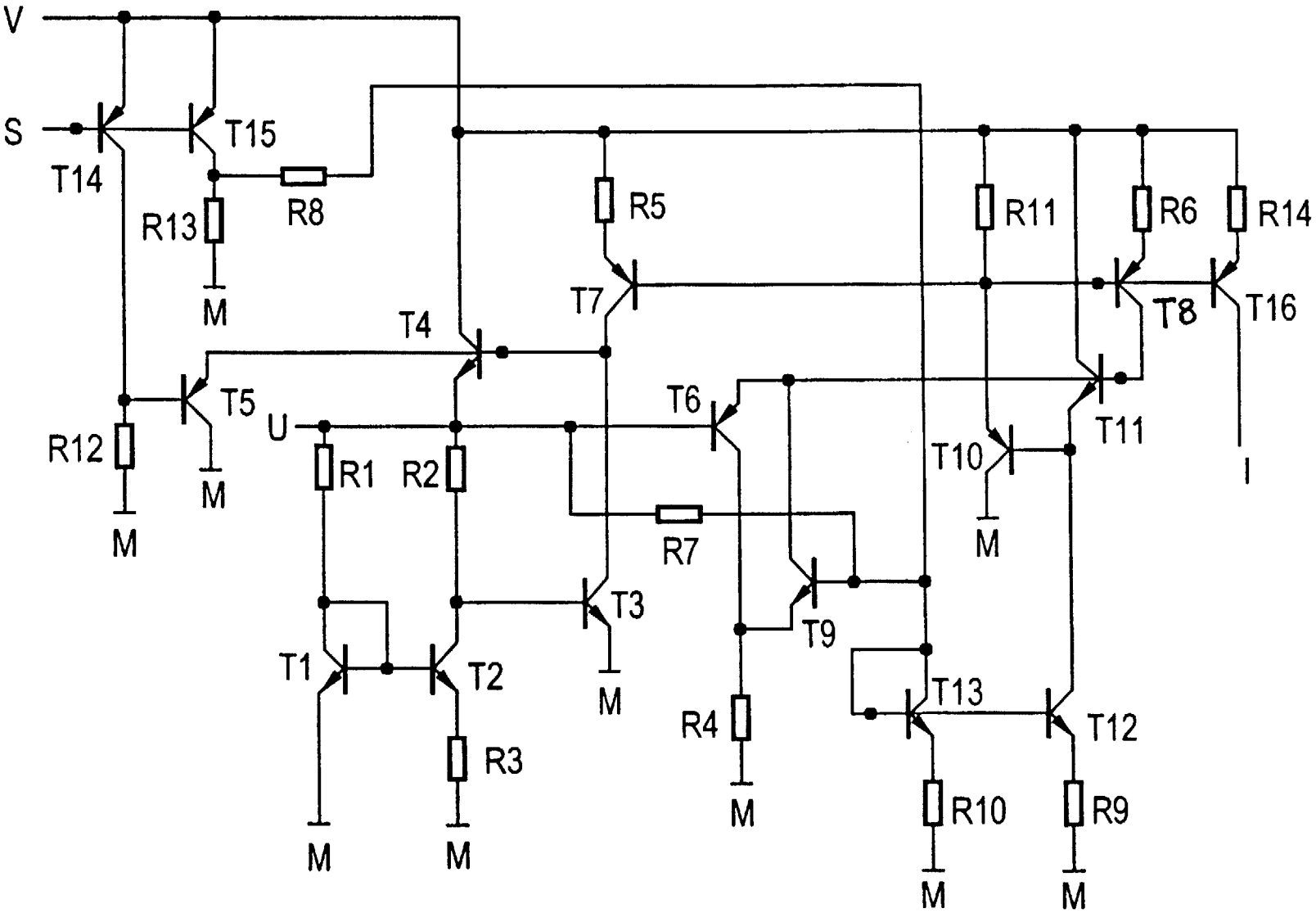
R14
T16
I
R6
T8
T11
T12
R9
M
R11
T10
M
T13
R10
M
T9
M
R4
T6
R7
R5
T7
T3
M
T4
R2
T2
R3
M
R1
T1
M
R8
U
T15
R13
M
T5
M
T14
R12
M
V
S

ACTIVATABLE/DEACTIVATABLE CIRCUIT ARRANGEMENT FOR PRODUCING A REFERENCE POTENTIAL

BACKGROUND OF THE INVENTION

1. Field of the Invention

The present invention concerns an activatable/deactivatable circuit arrangement for producing an output reference voltage, having a first transistor whose emitter is connected with a reference potential and whose base and collector are connected with one another, having a second transistor whose base is connected with the base of the first transistor, having a first resistor connected between the collector of the first transistor and an output terminal for supplying the output reference voltage, having a second resistor connected between the collector of the second transistor and the output terminal, having a third resistor connected between the emitter of the second transistor and the reference potential, having a third transistor whose base is connected with the collector of the second transistor and whose emitter is connected with the reference potential, and having a controlled current source that is connected between a supply potential and the output terminal and that has an input coupled with the collector of the third transistor.

2. Description of the Related Art

A circuit arrangement of the forgoing described type, which is also referred to as a band gap reference, is known for example from the publication by Paul R. Gray and Robert G. Meyer, entitled Analysis and Design of Analog Integrated Circuits, Second Edition, John Wiley and Sons, 1984, pages 293 to 296.

In the future, it will become increasingly more important in integrated circuits that for the purpose of saving power at least parts of the circuits can be activated and deactivated. Accordingly, activatable or, respectively, deactivatable reference voltage sources will also be used more and more, since the reference voltage source in the deactivated state should as far as possible consume no current. It would be an advantage over the art to provide for activating/deactivating the reference voltage source by means of a switching means connected in series. A pnp transistor generally lies in series with a band gap reference as a reference voltage source, so that the supply voltage has to be higher than is actually required for the band gap reference itself. Moreover, in standard technology pnp transistors can be realized only as large-surface lateral transistors. The base current for driving the pnp transistor is often not negligible, and increases current consumption during operation.

SUMMARY OF THE INVENTION

An object of the present invention is to provide an activatable/deactivatable circuit arrangement for producing an output reference voltage that does not have the disadvantages described above.

This and other objects and advantages are provided by a circuit arrangement for producing an output reference voltage, the circuit in detail having a first transistor whose emitter is connected with a reference potential and whose base and collector are connected with one another, having a second transistor whose base is connected with the base of the first transistor, having a first resistor that is connected between the collector of the first transistor and an output terminal for supplying the reference potential, having a second resistor that is connected between the collector of the second transistor and the output terminal, having a third resistor that is connected between the emitter of the second transistor and the reference potential, having a third transistor whose base is connected with the collector of the second transistor and whose emitter is connected with the reference potential, and having a controlled current source that is connected between a supply potential and the output terminal, and that has an input coupled with the collector of the third transistor, the collector-emitter path of a fifth transistor being connected in parallel with the collector-emitter path of the third transistor, and the base of the fifth transistor being driven by a switching signal.

Embodiments and developments of the invention are the provided by a circuit arrangement having the controlled current source comprising a fourth transistor whose collector is connected with the supply potential and whose emitter is connected with the output terminal and whose base is connected with the collector of the third transistor, and a further current source being connected between the base and collector of the fourth transistor.

In a preferred development, the further current source comprises a sixth transistor whose base is connected with the output terminal and whose emitter is connected with the reference potential with the intermediate connection of a fourth resistor; a seventh transistor whose emitter is connected with the supply potential with the intermediate connection of a fifth resistor and whose collector is connected with the base of the fifth transistor and whose base is coupled with the collector of the sixth transistor; an eighth transistor whose base and collector are coupled with one another as well as with the collector of the sixth transistor and whose emitter is connected with the supply potential with the intermediate connection of the sixth resistor.

Preferably, the collector-emitter path of a ninth transistor is connected in parallel to the collector-emitter path of the sixth transistor, and the base of the ninth transistor is driven by the switching signal. A seventh resistor is connected between the base of the seventh and ninth transistors. As one development, the switching signal is supplied to the base of the ninth transistor via an eighth resistor. The circuit may have a tenth transistor whose emitter is connected with the bases of the seventh and eighth transistors and whose collector is connected with the reference potential, and an eleventh transistor whose collector is connected with the supply potential and whose base is connected with the collector of the eighth transistor and whose emitter is connected with the base of the tenth transistor, and a current mirror whose input branch is coupled with the base of the ninth transistor and whose output branch is coupled with the base of the tenth transistor.

A feature of the invention is that an eleventh resistor is connected between, on one hand, the bases of the seventh and eighth transistors and, on the other hand, the supply potential. The switching signal is supplied to the bases of the fifth and ninth transistor, respectively, through an intermediate buffer stage.

To avoid a large surface area requirement for the circuit as well as unnecessary voltage and current losses, the overall concept behind the invention is that a switching means are incorporated into a band gap reference. In particular, in a circuit arrangement of the type described initially, the collector-emitter path of a fifth transistor is connected in parallel with the collector-emitter path of the third transistor and the base of the fifth transistor is driven by a switching signal.

In an embodiment of the invention, the controlled current source comprises a fourth transistor whose collector is connected with the supply potential and whose emitter is connected with the output terminal and whose base is connected with the collector of the third transistor.

An additional current source is thereby connected between the base and collector of the fourth transistor. Furthermore, the additional current source can comprise a sixth transistor whose base is connected with the output terminal and whose emitter is connected with the reference potential via a fourth resistor. In addition, a seventh transistor is provided whose emitter is connected with the supply potential via a fifth resistor and whose collector is connected with the base of the fourth transistor and whose base is coupled with the collector of the sixth transistor, and an eighth transistor is provided whose base and collector are connected with one another as well as with the collector of the sixth transistor and whose emitter is connected with the supply potential via a sixth resistor.

In order to improve the startup characteristics during activation, the circuit is provided with the collector-emitter path of a ninth transistor connected in parallel with the collector emitter path of the sixth transistor and the base of the ninth transistor is driven by means of the switching signal.

In addition, a seventh resistor can be connected between the bases of the sixth and ninth transistors. Furthermore, the switching signal can be supplied to the base of the ninth transistor via an eighth resistor.

A development of the invention contains a tenth transistor whose emitter is connected with the bases of the seventh and eighth transistor, and whose collector is connected with the reference potential. Furthermore, an eleventh transistor is provided whose collector is connected with the supply potential and whose base is connected with the collector of the eighth transistor and whose emitter is connected with the base of the tenth transistor. The base of the ninth transistor is thereby coupled with the input branch of a current mirror whose output branch is coupled with the base of the tenth transistor.

An eleventh transistor, which contributes to the increase of the stability, can be connected between the bases of the seventh and eighth transistor, on one hand, and the supply potential, on the other hand.

Finally, it can be provided that the switching signal is supplied to the bases of the fifth and sixth transistor, respectively, via a buffer stage.

BRIEF DESCRIPTION OF THE DRAWINGS

In the following, the invention is described in more detail on the basis of the exemplary embodiment shown in the single FIGURE of the drawing.

DETAILED DESCRIPTION OF THE PREFERRED EMBODIMENTS

In the inventive circuit arrangement shown as an exemplary embodiment, an npn transistor T1 is provided whose emitter is connected with the reference potential M and whose base and collector are connected with one another and are coupled, via a common resistor R1, with an output terminal U that carries an output reference voltage. The base of an npn transistor T2 is connected to the base and collector of the transistor T1, the emitter of the transistor T2 being coupled, via a resistor R3, with the reference potential M, and the collector thereof being coupled with the output terminal U via a resistor R2.

In addition, the emitter of an npn transistor T4 is connected to the output terminal U, the collector of the transistor T4 being connected with a supply potential V. The base of the transistor T4 is connected with the collector of an npn transistor T3 whose emitter is connected to the reference potential M and whose base is connected to the collector of the transistor T2.

In addition, the base of the transistor T4 is connected to the supply potential V via a current source circuit. The current source circuit comprises a pnp transistor T7 whose emitter is connected, via a resistor R5, with the supply potential V and whose collector is connected with the base of the transistor T4 or, respectively, with the collector of the transistor T3. The base of the transistor T7 is connected with the base of a pnp transistor T8 whose emitter is coupled with the supply potential V via a resistor R6. In addition, the collector of the transistor T8 is connected with the collector of an npn transistor T6, whose emitter is connected to the reference potential M via a resistor R4 and whose base is connected with the output terminal U.

In addition to the output terminal U at which the output reference voltage can be obtained, an output terminal I that carries an output reference current can additionally be provided. For this purpose, the output terminal I is connected with the collector of a pnp transistor T16 whose emitter is connected with the supply potential V via a resistor R14 and whose base is connected with the bases of the transistors T7 and T8.

According to the invention, the collector-emitter path of the transistor T3 is connected in parallel with the collector-emitter path of a pnp transistor T5. The emitter of the transistor T5 is thus connected with the base of the transistor T4 and the collector of the transistor T5 is connected to the reference potential M. The base of the fifth transistor T5 is driven by means of a switching signal S via a buffer stage. The buffer stage consists of a pnp transistor T14, to whose base the switching signal S is applied and whose emitter is coupled with the supply potential V and whose collector is coupled with the base of the fifth transistor T5, as well as with the reference potential M via a resistor R12. In place of a pnp transistor T5, an npn transistor can also be used in the same way, given a corresponding change in the polarity and corresponding design of the switching signal S.

Furthermore, the collector-emitter path of an npn transistor T9 is connected in parallel to the collector-emitter path of the transistor T6. The base of the transistor T9 is driven by the switching signal S with the intermediate connection of a resistor R8 as well as of an additional buffer stage. Accordingly, the emitter and the collectors of the transistors T6 and T8 are respectively connected with one another. The additional buffer stage contains a pnp transistor T15 whose emitter is connected with the supply potential V and whose base is connected with the base of the transistor T14. The collector of the transistor T15 is coupled, on one hand, with one terminal of the resistor R8 and, on the other hand, via a resistor R13, with the reference potential M.

The base of the transistor T9 is additionally connected with the input branch of a current mirror. The input branch is formed by an npn transistor T13 whose base and collector are connected with one another as well as with the base of the transistor T9, and whose emitter is connected to the reference potential M with the intermediate connection of a resistor R10. The output branch of the current mirror is formed by an npn transistor T12 whose base is connected with the base of the transistor T13 and whose emitter is connected to the reference potential M with the intermediate connection of a resistor R9. The collector of the transistor T12 is led to the base of a pnp transistor T10 whose collector is connected with the reference potential M and whose emitter is connected with the bases of the transistors T7 and T8 and is led to the emitter of an npn transistor T11 whose collector is connected with the supply potential V and whose base is connected with the collector of the transistor T8. Finally, a resistor R11 is connected between the bases of the transistors T7 and T8, on one hand, and the supply potential V, on the other hand.

If the transistors T14 and T15 are blocked by the switching signal S, their collector potentials are approximately equal to the reference potential M. The transistor T5 is then likewise blocked and has no influence on the function of the remaining circuit parts. In this case, the transistor T4 is driven in a manner corresponding to its function. The transistor T15 supplies a startup current for the band gap cell, which in the present embodiment consists of the transistors T1 and T2 as well as the resistors R1 to R3. If, in contrast, the transistors T14 and T15 are turned on by the switching signal S, their respective collector potential is approximately equal to the supply potential V. The transistor T5 is thereby likewise turned on and produces at the base of the transistor T4 a potential that likewise brings this transistor into the blocking state. The current consumption of the band gap cell thereby goes to zero. The resistor R8, as well as its combination with a complementary emitter follower consisting of the transistors T10 and T11, supports the deactivation process.

Thus, only the transistor T4, which is required anyway, lies in series with the band gap cell. An additional activation/deactivation transistor is not required. A serial voltage drop is thus avoided and moreover the additional surface area requirement for the circuit is kept low. By means of the transistors T9 to T13 in connection with the resistors R8 and R11, the remaining circuit parts are also kept largely at zero current, so that overall the current consumption in the idle state, as well as the current required for the deactivation means, as against the supply current in case of operation, is kept as low as possible.

Although other modifications and changes may be suggested by those skilled in the art, it is the intention of the inventors to embody within the patent warranted hereon all changes and modifications as reasonably and properly come within the scope of their contribution to the art.

I claim:

1. An activatable/deactivatable circuit arrangement for producing an output reference voltage at an output terminal, the circuit being provided with a reference potential and a supply potential, comprising:

a first transistor whose emitter is connected with the reference potential and whose base and collector are connected with one another, a second transistor whose base is connected with the base of said first transistor, a first resistor connected between the collector of said first transistor and an output terminal for supplying the output reference voltage, a second resistor connected between the collector of said second transistor and said output terminal, a third resistor connected between the emitter of said second transistor and the reference potential, a third transistor whose base is connected with the collector of said second transistor and whose emitter is connected with the reference potential, a controlled current source connected between the supply potential and the output terminal and having an input coupled with the collector of said third transistor, and a fifth transistor having a collector-emitter path connected in parallel with the collector-emitter path of said third transistor and a base of said fifth transistor being driven by a switching signal.

2. An activatable/deactivatable circuit arrangement according to claim 1, wherein said controlled current source includes a fourth transistor whose collector is connected with the supply potential and whose emitter is connected with the output terminal and whose base is connected with the collector of said third transistor, and further comprising a further current source connected between the base and collector of said fourth transistor.

3. An activatable/deactivatable circuit arrangement according to claim 2, wherein said further current source includes:

a sixth transistor whose base is connected with the output terminal;

a fourth resistor connected between the reference potential and an emitter of said sixth transistor;

a seventh transistor whose collector is connected with the base of said fifth transistor and whose base is coupled with the collector of said sixth transistor;

a fifth resistor connected between an emitter of said seventh transistor and the supply potential;

an eighth transistor whose base and collector are coupled with one another as well as with the collector of said sixth transistor; and a sixth resistor connected between an emitter of said eighth transistor and the supply potential.

4. An activatable/deactivatable circuit arrangement according to claim 2, further comprising:

a ninth transistor having a collector-emitter path connected in parallel to the collector-emitter path of said sixth transistor and a base of said ninth transistor being driven by the switching signal.

5. An activatable/deactivatable circuit arrangement according to claim 4, further comprising:

a seventh resistor connected between a base of said seventh transistor and a base of said ninth transistor.

6. An activatable/deactivatable circuit arrangement according to claim 4, further comprising:

an eighth resistor connected between the switching signal and a base of said ninth transistor.

7. An activatable/deactivatable circuit arrangement according to claim 4, further comprising:

a tenth transistor whose emitter is connected with bases of said seventh and eighth transistors and whose collector is connected with the reference potential, an eleventh transistor whose collector is connected with the supply potential and whose base is connected with the collector of said eighth transistor and whose emitter is connected with a base of said tenth transistor; and a current mirror having an input branch coupled with a base of said ninth transistor and having an output branch coupled with a base of said tenth transistor.

8. An activatable/deactivatable circuit arrangement according to claim 7, further comprising:

an eleventh resistor connected between the bases of said seventh and eighth transistors and the supply potential.

9. An activatable/deactivatable circuit arrangement according to claim 4, further comprising:

a buffer stage connected between the switching signal and bases of said fifth and ninth transistors.

* * * * *